US007426797B2

(12) United States Patent
Delaney

(10) Patent No.: US 7,426,797 B2
(45) Date of Patent: Sep. 23, 2008

(54) PRIVACY TABLET

(75) Inventor: John Delaney, Greensboro, NC (US)

(73) Assignee: Genuity Concepts, Greensboro, NC (US)

( * ) Notice: Subject to any disclaimer, the term of this patent is extended or adjusted under 35 U.S.C. 154(b) by 0 days.

(21) Appl. No.: 11/151,860

(22) Filed: Jun. 13, 2005

(65) Prior Publication Data

US 2006/0277804 A1 Dec. 14, 2006

(51) Int. Cl.
*B41J 11/38* (2006.01)

(52) U.S. Cl. ..... 40/341

(58) Field of Classification Search ..... 40/341, 40/375; 312/304, 139.2, 297; 346/25, 41
See application file for complete search history.

(56) References Cited

U.S. PATENT DOCUMENTS

| | | | | | |
|---|---|---|---|---|---|
| 391,506 | A | * | 10/1888 | Brown | 312/209 |
| 675,287 | A | * | 5/1901 | McLean | 40/341 |
| 1,441,229 | A | * | 1/1923 | Lacey | 160/310 |
| 1,458,488 | A | * | 6/1923 | Lee et al. | 281/6 |
| 1,720,607 | A | * | 7/1929 | Reed | 248/452 |
| 2,102,820 | A | * | 12/1937 | Scheinman | 312/297 |
| 2,341,914 | A | * | 2/1944 | Fleischman | 312/276 |
| 2,756,272 | A | * | 7/1956 | Holland et al. | 178/18.03 |
| 2,805,910 | A | * | 9/1957 | Townsend | 312/273 |
| 3,065,978 | A | * | 11/1962 | Stephens | 281/34 |
| 3,645,597 | A | * | 2/1972 | Sakow | 312/297 |
| 3,837,464 | A | * | 9/1974 | Baughman et al. | 400/685 |
| 4,345,392 | A | * | 8/1982 | Cornell | 40/116 |
| 4,703,953 | A | * | 11/1987 | Woods | 462/32 |
| 5,264,765 | A | * | 11/1993 | Pecorino et al. | 318/265 |
| 6,003,052 | A | * | 12/1999 | Yamagata | 708/100 |
| 6,012,787 | A | * | 1/2000 | Jennings et al. | 312/140.3 |
| 6,161,316 | A | | 12/2000 | Bolon | |
| 6,241,528 | B1 | * | 6/2001 | Myers | 434/408 |
| 6,804,787 | B2 | | 10/2004 | Dick | |
| 6,896,028 | B2 | | 5/2005 | Brennan | |
| 2001/0043196 | A1 | * | 11/2001 | Mattson | 345/173 |
| 2002/0123909 | A1 | | 9/2002 | Salisbury | |
| 2003/0088440 | A1 | | 5/2003 | Dunn | |

* cited by examiner

*Primary Examiner*—Lesley D. Morris
*Assistant Examiner*—Christopher E Veraa
(74) *Attorney, Agent, or Firm*—The Soni Law Firm

(57) ABSTRACT

A privacy tablet whereby an individual may make a written of other printed input information on a writing surface and thereafter immediately cover the portion of the writing surface so as to protect the confidentiality, security or privacy of the information from the view of subsequent users of the tablet. The covering operation may be manual or may be motorized and automated. Moreover, the motion of the cover may be restricted from unauthorized reversal and resultant observation of the information by a locking means. Lastly, any of the numerous generally planar surfaces of the tablet are well suited for and may be utilized for the imprinting of graphical or advertising material for the purposes of advertising or promotion.

23 Claims, 3 Drawing Sheets

PRIVACY TABLET

FIELD OF THE INVENTION

The present invention is directed toward a device on which information may be recorded and the confidentiality and privacy of same may be maintained. More specifically, the invention is directed toward a writing tablet whereby the entry may be written, typed or otherwise noted and the writer may then manipulate the tablet so as to cover the portion on which the entry is located. In so doing, the invention assures the privacy and hence, the confidentiality of the information, which has become increasingly necessary, for example, in the medical services profession.

BACKGROUND OF THE INVENTION

The present invention generally relates to a writing tablet used in various applications where the security or privacy of the information written therein is a concern. In recent years, as society has entered the "information age" there has arisen a compelling need for privacy, confidentiality ands security of the information gathered, especially that of an individual. One example of this issue is the privacy of information divulged by an individual to a medical services provider. Even the name of the patient should be maintained in a confidential manner.

In other contexts, however, privacy is of paramount import. In a government facility, or even a private business, often the visitor log must be kept confidential. In addition, much of the information maintained in these facilities must be maintained at a certain level of security clearance.

Prior devices have attempted to meet the needs of information privacy but have fallen short of the desired mark. U.S. Pat. No. 6,896,028, to Brennan describes a privacy screen often utilized in the medical services industry. Clearly, however, such a device only protects the patient during examination and fails to address the need to maintain the privacy of written or stored information.

U.S. Pat. No. 6,804,787 to Dick and U.S. patent application Ser. No. 2002/0123909 to Salisbury detail systems and devices which may be utilized in various industries to maintain and share records to afford privacy of the information. These systems and devices, however, deal with stored records, typically on a business computer system. They fail to address the rudimentary issue of privacy of information from the moment an individual enters a business or service provider.

A log ion and badge system is described in U.S. Pat. No. 6,191,316 to Bolon. This device, is practical only in those circumstances wherein a visitor must wear an identification badge into the premises. Such a system would not be effective in a medical services operation, legal services provider or any other type of business where even the very identity of the individual should be confidential. Moreover, with this system, the used badges must be contained and are often disposed in a common receptacle. This defeats the purpose of privacy, as a curious entity need only peruse the trash to discern exactly who entered, as well as possibly the time and purpose of the visit.

What is needed is a security and privacy tablet wherein the information may be written or noted and then immediately covered to prevent subsequent disclosure, even if inadvertent. An additional feature which would be advantageous would be to maintain the tablet in a manner such that information could be thereafter maintained as confidential but stored in a desired manner, such as on a single entry sheet for any given day.

SUMMARY OF THE INVENTION

The present invention addresses and overcomes the need for records and written entries to be maintained in a confidential and private manner. By incorporating a rolling cover with a writing tablet, the present invention permits the user to liberally make notations on the tablet and thereafter cover as much of the information as desired to prevent display to curious eyes. For example, in one preferred embodiment, the invention may reside on the sign in counter of a medical services provider. As each patient signs in, the attendant may view their information and would thereafter roll the cover over the writing tablet so as to cover the entry made by the individual. As such, the service provider maintains a full log of its patients yet each entry is kept private and confidential.

In a typical embodiment of the present invention, it comprises a portable tablet body having a writing surface and a covering means for preserving privacy of those writings from future users. The writing surface may in itself comprise a writing medium upon which written or printed entries may be directly made, such as paper or a whiteboard, or may form a recessed area in which a separate writing medium such as a notepad may be removably retained, and the cover could be an attached rolling accordion device for covering a portion of the writing surface following the entry of a written or printed notation on the surface. By sequentially covering, for example, horizontal lines of the pad upon which new entries of written information are made, others could not discern what has been previously written or printed thereon by the prior user.

The present invention may be made and used in various configurations and sizes consistent with the anticipated use of the invention. The invention may be a full size paper tablet with a covering as described above, or, for example, it may be a small hand held screen on which the user inputs his or her information. It may include paper, a whiteboard, or any other type of surface on which material may be printed or written. It could also include some type of input means, such as a keyboard, with which the user of the invention could type or print the necessary information.

In addition, the present invention meets the need to incorporate a means by which the information may be organized and stored permanently in a desired manner. It may be designed and configured such that the information noted therein may be subsequently cataloged or permanently stored in any number of desired methods. As in the medical services provider example described above, the invention may include a paper medium with a desired layout. Following the close of business each day, the written sheets may be removed by an employee and filed in chronological order, if desired. In that way, the provider would be able to quickly locate and provide confirmation of a visit, or the lack thereof, if these facts were later questioned. This file could also serve as a secondary contact file with a follow up or tickler file for future appointments, mailing of reminders or other subsequent needs.

The present invention may include further privacy and security precautions, depending on the need for these advanced security levels. For example, the rolling cover could be fully automated such that upon completion of a written entry or based on a time sequence, the cover automatically advances to cover the entries. Whether manual or motorized, the cover mechanism may include a means by which reverse movement of the cover is restricted by some type of locking device. If desired, there would be a release button to disengage the locking means, for example, if a medical provider required access to an entry later in the day of the visit. This release may be as simple as a release button, or it may require insertion of a key, for the utmost restriction and security.

Finally, it is contemplated that any of the numerous outer surfaces of the hand held implement are well suited for and may be utilized for the imprinting of graphical or advertising material for the purposes of advertising or promotion.

BRIEF DESCRIPTION OF THE DRAWINGS

These and other aspects of the invention will now be described with reference to the accompanying drawings, in which.

DETAILED DESCRIPTION OF THE PREFERRED EMBODIMENT OF THE INVENTION

The accompanying FIGS. depict embodiments of the present invention, and features and components thereof. With regard to means for fastening, mounting, attaching or connecting the components of the present invention to form the apparatus as a whole, unless specifically described otherwise, such means are intended to at least encompass conventional fasteners such as machine screws, machine threads, snap rings, hose clamps such as screw clamps and the like, rivets, nuts and bolts, toggles, pins and the like. Components may also be connected by friction fitting, snap fitting, adhesives, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, injection molding and machining may be used.

Any references to front and back, right and left, medial and lateral, top and bottom, upper and lower, superior and inferior, and horizontal and vertical are intended for convenience of description, not to limit the present invention or its components to any one positional or spacial orientation.

The present invention involves a device for the writing or entry of information onto an information surface with the ability to thereafter cover the information so as to maintain confidentiality, security and privacy of the information. In a rudimentary embodiment, the present invention includes a coverable writing surface as shown in the included figures.

Figure 1:
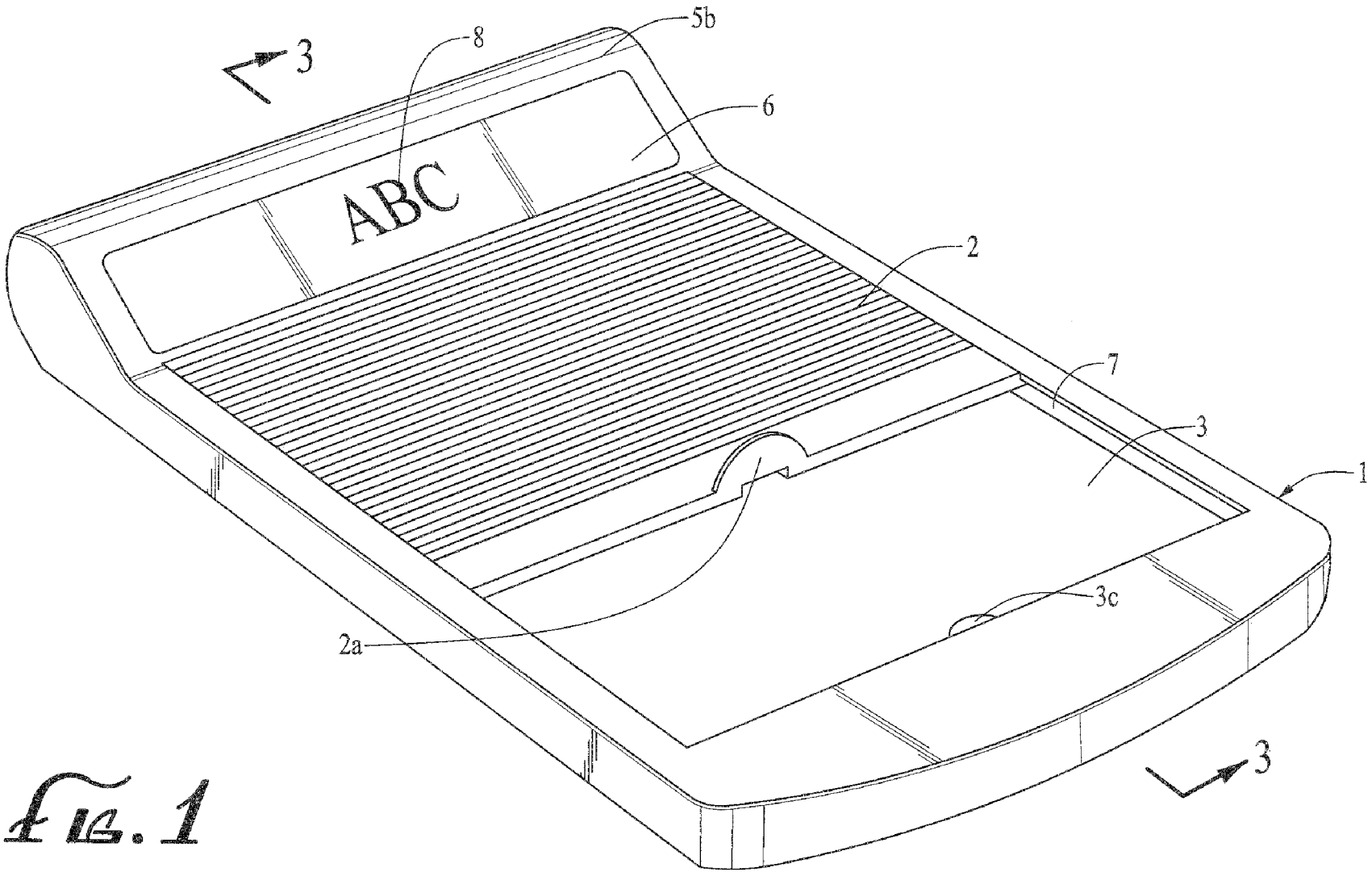
FIG. 1 is a front perspective view of a preferred embodiment of the invention in the configuration of a writing tablet with an accordion style rolling cover shown in a position where the cover is partially closed.
Figure 2:
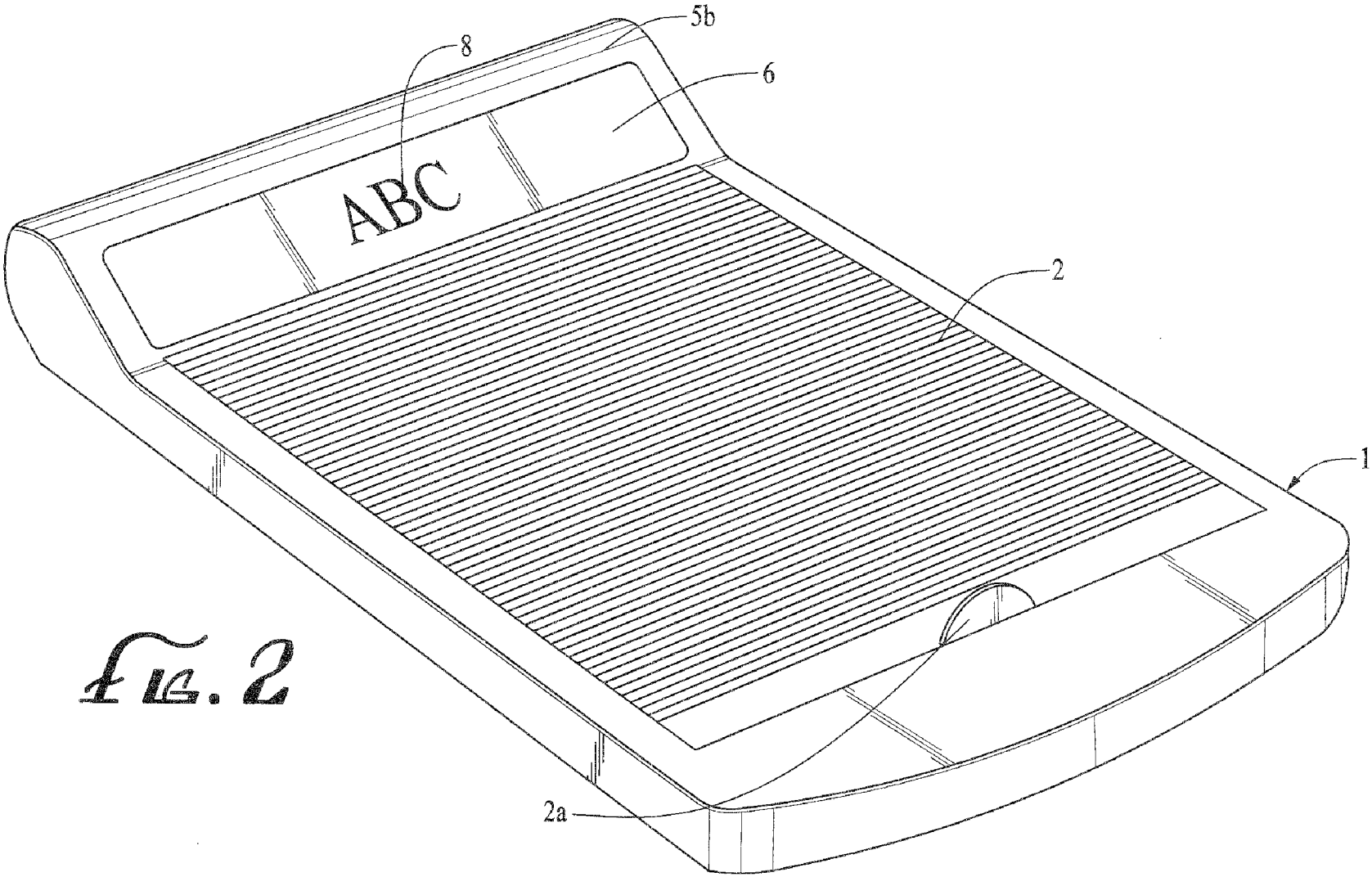
FIG. 2 is a front perspective view of a preferred embodiment of the invention in the configuration of a writing tablet with an accordion style rolling cover shown in a position where the cover is fully closed.
Figure 3:
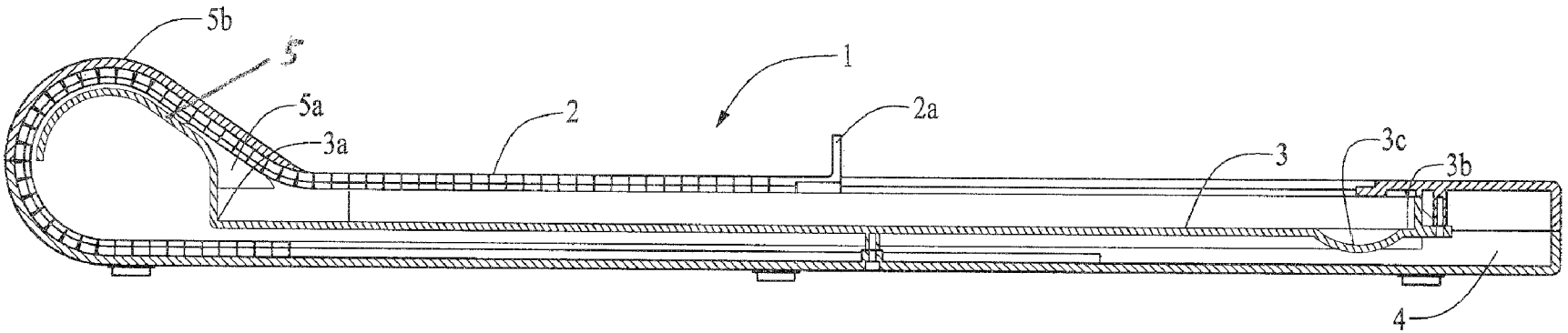
FIG. 3 is a side cross-sectional view of a preferred embodiment of the invention in the configuration of a writing tablet with an accordion style rolling cover shown in a position where the cover is partially closed. This figure shows the cover as it wraps around the base of the tablet inside of an enclosure so as to enable the cover to roll from a completely open position to a fully closed position.

Referring to FIGS. 1-3, the present invention in a preferred embodiment comprises a portable tablet body 1 having a substantially planar writing surface 3 and a rolling cover 2. The portable tablet body 1 would typically be fabricated of a moldable plastic or similar polymer due to the low cost and ease of construction with such materials. There is no reason, however, why the portable tablet body 1 could not be made of a metallic or readily deformable material, such as aluminum. These types of materials would be especially advantageous for uses in adverse environments, such as outdoors, or in areas where the enclosure 1 may be exposed to chemicals that could deteriorate a polymer material.

The writing surface 3 in the preferred embodiment is to the bottom of a rectangular recessed area defined on the tablet body 1 which is sized and configured to removably retain therein an ordinary paper writing pad of standard size. As such, its replacement would be quite economical and future storage of the information on the pad could easily be accomplished, for example in a chronological file. In order to facilitate the removal of any notepad on the writing surface 3, the writing surface in this embodiment may further define a depression 3*c* at a lower marginal edge 3*b* thereof so that a user may insert her or his finger into the depression 3*c* and easily remove the notepad placed thereupon. The type of the writing surface 3 need not be so limited however. It may also be any surface or medium on which one may directly input, write, print or otherwise locate or enter information For example, the writing surface 3 may be a whiteboard material or it may be or incorporate a digital or electronic means such as a screen and/or keyboard. The concept of information privacy is equally applicable to these and many other types of configuration for the writing surfaces 3.

Referring now to FIG. 3, the tablet body 1 further has an elongated ridge 5*b* integrally formed therewith, which generally extends from an upper marginal edge 3*a* of the writing surface 3 The ridge 5*b* defines therein a curved hollow channel 5*a* which extends at an obtuse angle from the writing surface 3. The tablet body 1 further defines a straight hollow channel 4 defined under the base of the writing surface 3, which contiguously extends from the curved hollow channel 5*a,* such that when in an open or a partially closed position, the cover 2 is retracted and the unused portion of the cover 2 resides in the curved hollow channel 5*a* and the straight hollow channel 4 below the writing surface 3 base, To ensure smooth travel of the cover 2, the preferred embodiment further includes a curved track 5 contiguously extending from the upper marginal edge 3*a* of the writing surface 3 into the curved hollow channel 5*a* on which the cover 2 rolls forward and returns, Rather than force the rolling cover 2 to translate 180° as it translates from a position of covering the writing surface 2 to a position within the straight hollow channel 4 and the reverse, the curved track 5 provides a smooth transitional surface on which the cover 2 rides, Having the curved track 5 thus provides both a smoother operating device as well as a longer lasting product, in part due to the reduced stress on the accordion jointed rolling cover 2. As shown in FIGS. 1 and 2, the cover 2 may include a finger tab 2*a,* for manual advancement of the rolling cover 2.

As shown in FIGS. 1-3, the accordion-typed rolling cover 2 is a thin slab which is engaged with the tablet body 1 via two opposing guiding grooves 7 formed at the sides of the tablet body and slidably movable above the writing surface 3. It is selectively positionable between a first position substantially exposing the writing surface 3 by retracting into the curved channel 5*a* and straight channel 4, a second position substantially covering the writing surface 3 by extending out of the curved and straight channels as seen in FIG. 2, and a plurality of intermediate positions between the first and second positions partially exposing the writing surface 3, as seen in FIGS. 1 and 3. As shown in FIGS. 1 and 3, the cover 2 maintains, unless moved by a user, a stationary position at the first, second, and the plurality of intermediate positions so that the user may freely view or make entries of written information on the writing surface 3 without having to keep holding the cover 2 in position to prevent it from retracting into the channels due to its own weight.

Although not shown in the accompanying figures, the present invention may also include further features for enhanced security and privacy. For example, while the unit shown in the drawings would typically be manually operated, it is well suited to motorized or automated movement of the cover 2. To achieve such operation, a small motor would generally be placed in the area of the curved track 5 so as to drive the cover 2 over the writing surface 3 and return the cover 2 to its original position when desired. This motor may utilize a common component such as a sprocket to drive the cover 2.

Similarly, the rolling cover 2 and tablet body 1 may further include a locking means to prevent an unauthorized reversal of the cover 2. This locking means could be as simple as a push button, or it may include a key insertion requirement for the utmost security and restricted access to reversal.

The preferred embodiment may further include a means by which the covering of the writing surface 3 is automated. This movement may be timed or it may rely upon a relay or sensor associated with the equipment. For example, a pen and a docking station for the pen may be included with the enclosure 1. As the individual completes their entry of information and returns the pen to the docking station, a relay or sensor would be tripped to commence movement of the cover a specified distance so as to cover the newly written entry. Similarly, if a stylus point were used to make the entry, the writing surface 3 could include a sensing material to detect the completion of an entry, the absence of stylus pressure or the return of the stylus to a predetermined position, whereby the cover 2 movement would be commenced.

Regardless of the specific embodiment, the invention could typically also include additional features for user convenience, the desired privacy level or improved performance. The aforementioned are but a few examples of such additional features and by no means described for the purpose of limiting the contemplated scope of the invention to same.

Finally, it is contemplated that any of the numerous generally planar surfaces of the present invention are well suited for and may be utilized for the imprinting of graphical or advertising material 8 for the purposes of advertising or promotion. One of these surfaces would be the substantially planar surface 6 formed on the ridge 5*b,* as shown in FIGS. 1 and 2, although the imprinting could also reside on one or more of the remaining outer surfaces of the invention.

What is claimed is:

1. A writing tablet, comprising:

a portable tablet body comprising:

a substantially planar writing surface having parallely opposed upper and lower marginal edges;

an elongated ridge extending from the upper marginal edge, the ridge defining a curved hollow channel therein, the curved channel extending at an obtuse angle from the writing surface;

a straight hollow channel defined underneath the writing surface and contiguously extending from the curved hollow channel; and a covering member connected to the tablet body and configured to slidably move above the writing surface, the covering member being selectively positionable between a first position substantially exposing the writing surface by retracting into the curved and straight channels, a second position substantially covering the writing surface by extending out of the curved and straight channels, and a plurality of intermediate positions between the first and second positions partially exposing the writing surface, wherein the covering member is configured to maintain, unless moved by a user, a stationary position in the first, the second, and any of the plurality of intermediate positions.

2. The writing tablet of claim 1 wherein the covering member is a rolling accordion cover.

3. The writing tablet of claim 1 wherein the writing surface comprises an erasable writing whiteboard.

4. The writing tablet of claim 1 wherein the covering member further includes a drive means for advancing the covering member thereby.

5. The writing tablet of claim 1, wherein advertising or graphical material is imprinted on at least one outer surface of the tablet for the purpose of advertising or promotion.

6. The writing tablet of claim 5, wherein a portion of the outer surface of the ridge is substantially planar and the advertising or graphical material is imprinted on the substantially planar portion.

7. The writing tablet of claim 4 wherein the drive means is energized so as to automatically move the covering member.

8. The writing tablet of claim 7 wherein the automatic motion of the covering member is initiated upon a user's return of a writing implement or other input device to a predetermined location with respect to the writing tablet.

9. The writing tablet of claim 1, wherein the tablet body defines a substantially rectangular recessed area thereon and the writing surface is a bottom thereof, whereby a notepad may be removably retained in the recessed area.

10. The writing tablet of claim 9, wherein the writing surface defines a depression proximate the lower marginal edge for accepting a user's finger to facilitate removal of the notepad on the writing surface.

11. The writing tablet of claim 1, wherein the elongated ridge includes a convexly curved track contiguously extending from the upper marginal edge of the writing surface and the curved hollow channel is defined above the track.

12. A writing tablet for selectively covering written information, the tablet comprising:

a notepad having a plurality of spaced-apart horizontal lines for writing the information thereon;

a portable tablet body comprising:

a substantially planar writing surface sized and configured to removably receive the notepad thereupon, the writing surface having parallelly opposed upper and lower marginal edges;

an elongated, ridge extending from the upper marginal edge, the ridge defining a curved hollow channel therein, the curved channel extending at an obtuse angle from the writing surface;

a straight hollow channel defined underneath the writing surface and contiguously extending from the curved hollow channel; and a covering member connected to the tablet body and configured to selectively and slidably extend out of and retract into the curved and straight hollow channels so as to sequentially cover and expose the plurality of horizontal lines of the notepad and the information written thereon, wherein the covering member is configured to maintain, unless moved by a user, a stationary position after covering one of the plurality of horizontal lines and exposing another of the plurality of horizontal lines

13. The writing tablet of claim 12, wherein advertising or graphical material is imprinted on at least one outer surface of the tablet for the purpose of advertising or promotion.

14. The writing tablet of claim 13, wherein a portion of the outer surface of the ridge is substantially planar and the advertising or graphical material is imprinted on the substantially planar portion.

15. The writing tablet of claim 12, wherein the covering member is a rolling accordion cover.

16. The writing tablet of claim 15, wherein the rolling accordion cover is energized so as to automatically move.

17. The writing tablet of claim 16, wherein the automatic motion of the rolling accordion cover is initiated upon a user's return of a writing implement or other input device to a predetermined location with respect to the tablet.

18. The writing tablet of claim 12, wherein the elongated ridge includes a convexly curved track contiguously extending from the upper marginal edge of the writing surface and the curved hollow channel is defined above the track.

19. The writing tablet of claim 12, wherein the tablet body defines a substantially rectangular recessed area thereon whose bottom is the writing surface.

20. The writing tablet of claim 19, wherein the writing surface defines a depression proximate the lower marginal edge for accepting a user's finger to facilitate removal of the notepad on the writing surface.

21. The writing tablet of claim 12, wherein the covering member further includes a drive means for advancing the cover thereby.

22. The writing tablet of claim 12, wherein the covering member is fabricated of plastic material.

23. A method of advertising comprising the steps of:

a) providing a writing tablet comprising:

a portable tablet body comprising:

a substantially planar writing surface having parallely opposed upper and lower marginal edges, an elongated ridge extending from the upper marginal edge, the ridge defining a curved hollow channel therein, the curved channel extending at an obtuse angle from the writing surface, a straight hollow channel defined underneath the writing surface and contiguously extending from the curved hollow channel, and a covering member connected to the tablet body and configured to slidably move above the writing surface, the covering member being selectively positionable between a first position substantially exposing the writing surface by retracting into the curved and straight channels, a second position substantially covering the writing surface by extending out of the curved and straight channels, and a plurality of intermediate positions between the first and second positions partially exposing the writing surface, wherein the covering member is configured to maintain, unless moved by a user, a stationary position in the first, the second, and any of the plurality of intermediate positions; and b) disposing advertising material on an outer surface of the writing tablet.

* * * * *